US006368530B1

(12) United States Patent
Adubato et al.

(10) Patent No.: US 6,368,530 B1
(45) Date of Patent: Apr. 9, 2002

(54) METHOD OF FORMING COOLING DUCTS IN CAST RESIN COILS

(75) Inventors: John D. Adubato, Monroe; Dilip R. Purohit, Charlotte; Scott F. Lett, Monroe, all of NC (US); Richard R. Rettew, Fort Mill, SC (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/465,080

(22) Filed: Dec. 16, 1999

(51) Int. Cl.[7] ..... B28B 1/48

(52) U.S. Cl. ..... 264/154; 264/272.2; 264/294; 264/272.19; 29/605; 29/606

(58) Field of Search ..... 264/162, 272.19, 264/272.2, 272.11, 294; 29/605, 606

(56) References Cited

U.S. PATENT DOCUMENTS

| | | | | |
|---|---|---|---|---|
| 2,856,639 A | * | 10/1958 | Forrest et al. | 264/272.19 |
| 3,633,140 A | * | 1/1972 | Lake et al. | 264/272.19 |
| 3,774,298 A | * | 11/1973 | Eley | 29/605 |
| 3,956,724 A | * | 5/1976 | Fagan, Jr. | 335/216 |
| 3,991,232 A | * | 11/1976 | Kamiuchi et al. | 264/134 |
| 4,013,908 A | * | 3/1977 | Weghaupt | 310/61 |
| 4,129,938 A | | 12/1978 | Hagenbucher | |
| 4,279,944 A | * | 7/1981 | Laskaris | 29/605 |
| 5,267,393 A | | 12/1993 | Purohit et al. | |
| 5,396,210 A | | 3/1995 | Purohit et al. | |
| 5,558,735 A | | 9/1996 | Rettew et al. | |

OTHER PUBLICATIONS

Exhibit A—France Tarnsfo Transformer With Heat Exchanger.
Exhibit B—General Electric Transformer With Heat Exchanger.
Exhibit C—FIG. 1 is a hand drawn sketch and FIG. 2 is a formal sketch showing the protective shield attached to the cooling fluid tank of the distribution transformer.

* cited by examiner

*Primary Examiner*—Angela Ortiz
(74) *Attorney, Agent, or Firm*—Michael J. Femal; Larry I. Golden

(57) ABSTRACT

An improved method for creating cooling ducts in cast resin coils uses uniform cross section thermoplastic tooling segments. These segments are wound into windings between predetermined layers or radial sections, oriented parallel to the coil axis. They extend through the height of the coil. After the coil is cast, impregnated, or saturated with resin, and the resin is cured, the segments are withdrawn. The removal of a segment results in a continuous cooling duct. The thermoplastic segments are either solid machined from sheet or extruded with thin outer walls. Extrusion allows for uniform cross section relatively long somewhat flexible segments, which will cause the radius of curvature of the segment to conform to the shape of the coil due to the tension from the conductor and reinforcing material during the winding process. This will have the result of reducing the number of different segment designs required to support production of a variety of different diameter coils. Elliptical or similar shaped coils with conforming cooling ducts are possible from the same segment design.

8 Claims, 9 Drawing Sheets

METHOD OF FORMING COOLING DUCTS IN CAST RESIN COILS

DESCRIPTION

1. Technical Field

Applicant's invention relates generally to coils for use in cast resin or other resin bonded structures such as transformer coils, and more particularly, to a method of forming cooling channels within the coil.

2. Background Art

A transformer generally consists of a laminated, ferromagnetic core, high voltage windings, and low voltage windings. The windings of dry type transformers with primary voltages over 600 volts have generally been constructed using one of three types of techniques: conventional dry, resin encapsulated, or solid cast. The conventional dry method uses some form of vacuum impregnation with a solventless type varnish on a completed assembly consisting of the core and the coils or individual primary and secondary coils. The resin-encapsulated method encapsulates a winding with a resin with or without a vacuum but does not use a mold to contain the resin during the curing process. This method does not insure complete impregnation of the windings with the resin and therefore the turn to turn insulation and layer insulation must provide the isolation for the voltage rating without consideration of the dielectric rating of the resin. The solid cast method utilizes a mold around the coil, which is the principal difference between it and the resin-encapsulated method. The windings are placed in the mold and impregnated and/or encapsulated with a resin under a vacuum, which is then allowed to cure before the mold is removed. Since all of the resin or other process material is retained during the curing process, there is a greater likelihood that the windings will be free of voids, unlike the resin encapsulated method whereby air can reenter the windings as the resin drains away before and during curing. Cooling channels can be formed as part of the mold. One type of such a transformer is manufactured by Square D Company under the trademark of Power-Cast transformers. Since the resin used in coating solid cast coils results in a greater solid bond between adjacent conductors than is possible with resin encapsulated coils, solid cast coils exhibit better short circuit strength of the windings. An added benefit is that by having greater mass, there is a longer thermal time constant with the solid cast type coils and there is better protection against short term overloads Various methods are available whereby cooling channels are formed within the channels. U.S. Pat. No 4,129,938 discloses one such method. Duct forming molds, wrapped in cloth, are inserted during the winding of the coil at predetermined locations. They are extracted by force after the resin has cured. Removing these molds can be very time consuming. The duct molds are usually machined tapered metallic segments, either steel or aluminum. The machining is necessary to create large cooling ducts that will match the contour of the coil. These coils are generally cylindrical or at least have major cylindrical components. Since there are a variety of coils, having varying dimensions and sizes, it becomes necessary to have many different duct molds ready available to accommodate the different sizes. An alternative have been to use aluminum or steel bar stock, coated with a suitable mold release compound, for relatively small cooling ducts. After the resin has cured, the bars are extracted under force, which again, can be time consuming. These bars are usually straight segments with no curvature. They must be relatively narrow or the space factor of the coil is adversely affected.

It would be preferable to find a lower cost method for forming cooling ducts that eliminates the need for many different duct molds to accommodate all the variations in coil size. In addition, it would be preferable that the duct molds be easier to extract from the cured coil, thus reducing the overall cycle time for manufacturing the complete coil.

SUMMARY OF THE INVENTION

Accordingly, the principal object of the present invention is to provide an improved method for forming cooling ducts in a cast resin or other resin bonded structure such as a transformer coil which overcomes the above mentioned disadvantages.

Another objective of the invention is to provide a universal duct mold for forming the cooling ducts in a variety of different sized coils.

In one embodiment of the invention, a uniform cross section thermoplastic tooling element or segment is used to create cooling ducts in a cast resin transformer coil. These segments are wound into the coil between predetermined layers or radial sections, oriented parallel to the coil axis. They extend through the height of the coil. After the coil is cast, impregnated, or saturated with resin, and the resin is cured, the segments are withdrawn. The removal of a segment results in a continuous cooling duct.

The thermoplastic segments may be machined from sheet stock. For relatively small coils they may be injection molded or cast. Solid segments are preferred over hollow extrusions because they are more durable. The preferred manufacturing method is to machine them from sheet or bar stock.

Thin walled extrusions with suitable reinforcement could also be used. They are somewhat flexible, which will cause the radius of curvature of the segment to conform to the shape of the coil due to the tension from the conductor and fiberglass reinforcing material during the coil winding process. Longitudinal reinforcing bars or tubes can be used to prevent the thin walled plastic extrusion from collapsing from tension in the winding. This will have the result of reducing the number of different segment designs required to support production of a variety of different diameter coils. Elliptical or similar shaped coils with conforming cooling ducts are possible from the same segment design. Unreinforced thick walled extrusions are less durable because they tend to collapse after repeated uses. Any hollow extrusion should be fitted with a flexible plug in the lower end to prevent the entry of liquid resin.

The thermoplastic material is selected based upon its ability to resist reacting or bonding with the coil bonding resin. It also will have a heat distortion temperature high enough to resist the heat associated with the resin curing process. Further, the thermoplastic material will have a coefficient of expansion greater than the coil bonding resin system to facilitate removal of the segment after curing.

Many variations of the segment design are possible, including using snap together elements, joined edge-to-edge to create varying length cooling ducts.

Other features and advantages of the invention will be apparent from the following specification taken in conjunction with the accompanying drawings in which there is shown a preferred embodiment of the invention. Reference is made to the claims for interpreting the full scope of the invention that is not necessarily represented by such embodiment.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
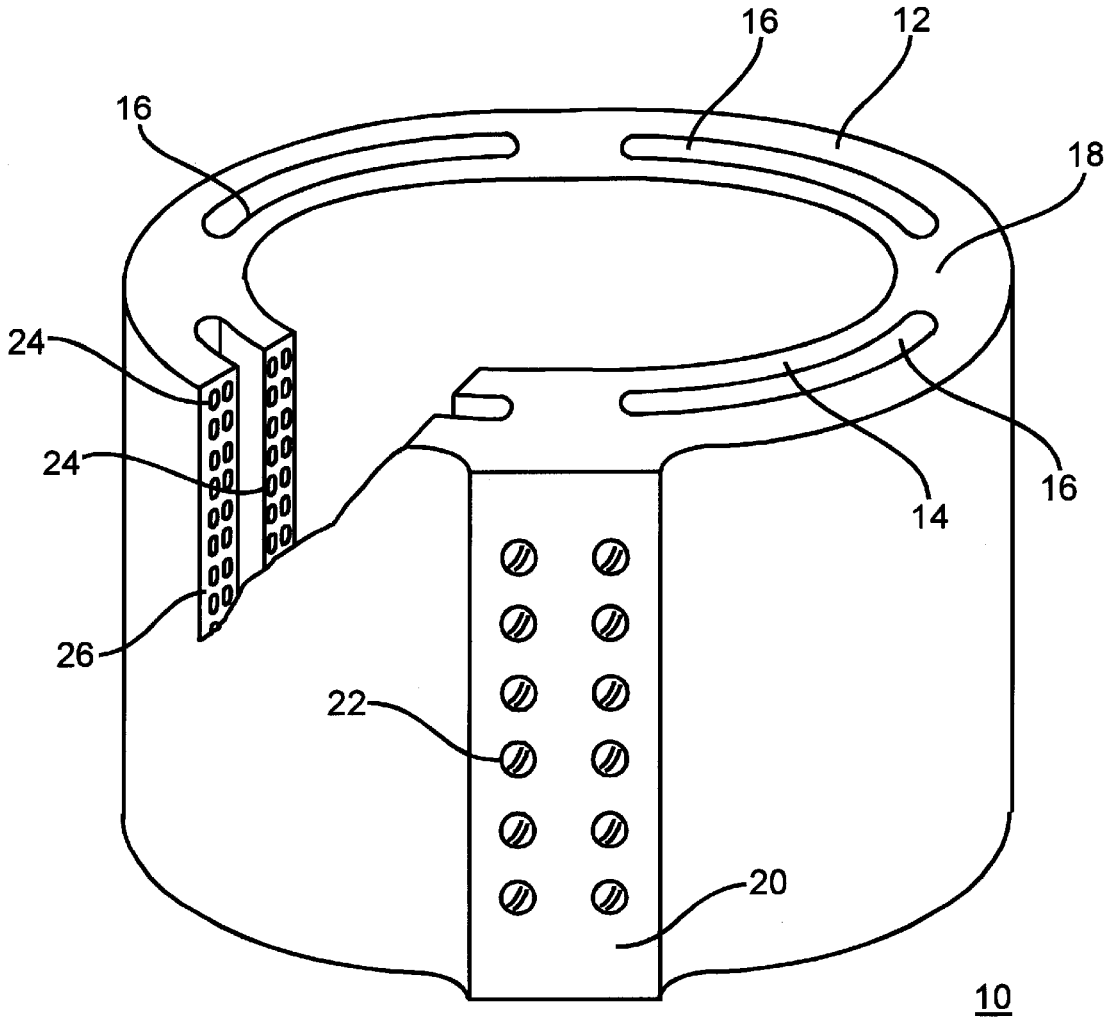
FIG. 1 is an isometric view of a cast resin or other resin bonded structure such as a transformer coil, with a cutaway view, constructed according to the present invention.

FIG. 1 illustrates a typical cast resin or other resin-bonded structure such as a transformer coil 10 constructed according to the present invention. Although a high voltage primary coil is shown, it is to be understood that the invention is not to be limited to only this type. Low voltage secondary coils can also be constructed using the same method. Low voltage coils can be wound using either wire or strip conductor. Likewise, the illustrated coil is cylindrical. Rectangular and elliptical designs can also use the same method described herein to form cooling ducts or channels within the cast resin coil. The coil 10 has two main winding layers 12, 14, with four cooling ducts 16 equally spaced and extending through the coil 10. The area 18 between cooling ducts 16 is filled with resin during the casting process. Although only one layer of cooling ducts is illustrated several layers of cooling ducts could be incorporated in a single coil. A terminal board 20 is formed as part of a mold used to cast the coil 10. Terminals 22 are coupled internally to predetermined locations of the windings 12, 14 to provide different tap input voltages and interconnections with other coils and voltage sources.

Unfilled epoxy resin is used as the solid encapsulant 24. Unfilled resin is preferred since filled resin does not impregnate well due to the increased viscosity. Further, mechanical reinforcement, such as the use of conventional sheet dielectric material between conductor layers is required. This will lead to a much thicker outside walls and in the cooling ducts. The cooling of the windings 12,14 is directly affected by any barrier between conductors 26 and air. Therefore, the resin barrier should be kept as small as possible to provide maximum heat transfer, but still maintain sufficient mechanical strength. In the preferred embodiment, the coils are wound with glass fiber and impregnated with a low viscosity unfilled resin such as a bisphenol A (BPA) epoxy cured with an anhydride.

Figure 2:
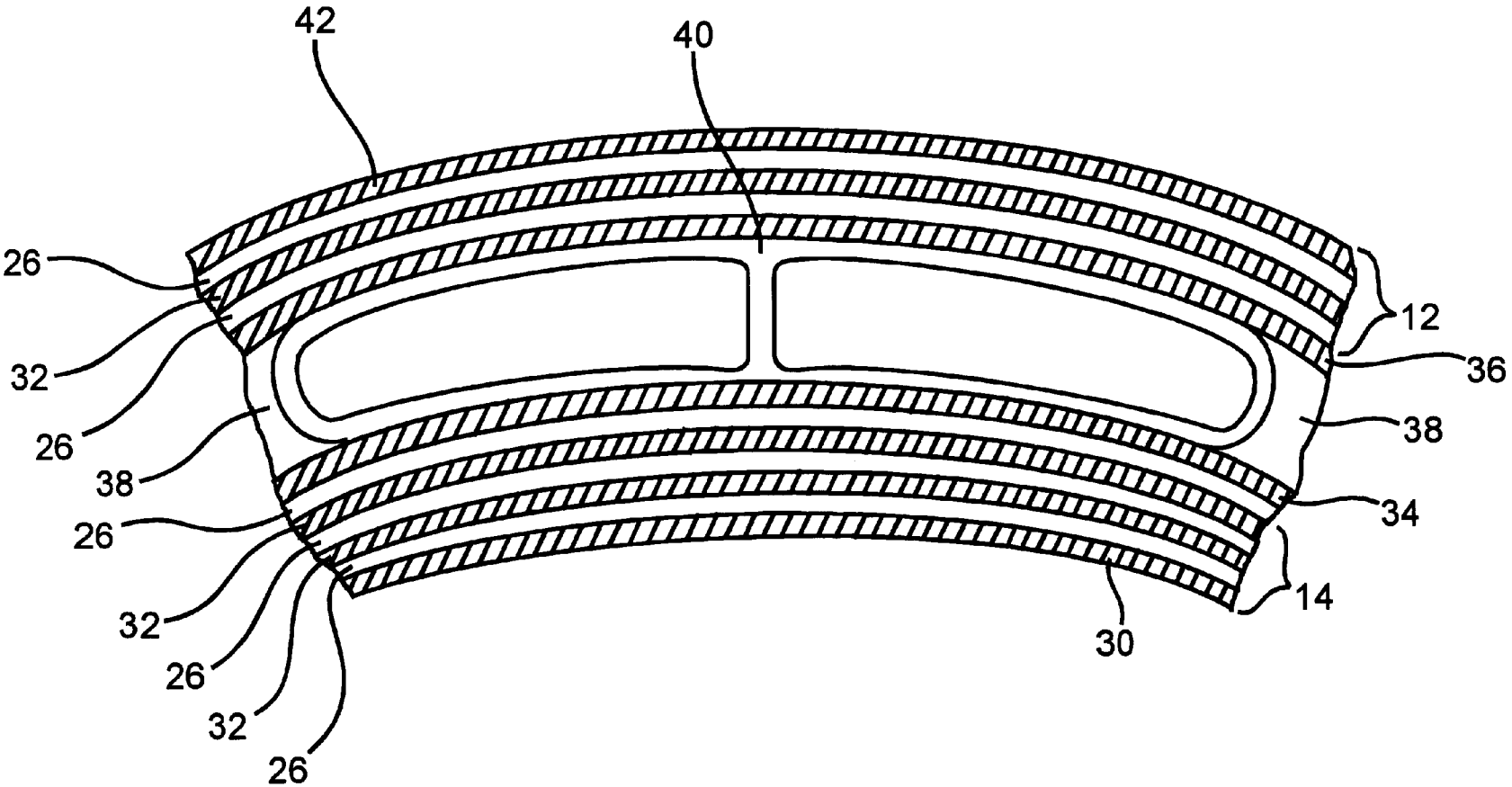
FIG. 2 is a partial cross sectional view of a transformer core depicted in FIG. 1, before being cast in resin, detailing an area surrounding a cooling duct formed according to the present invention.

A partial cross sectional view of the transformer core depicted in FIG. 1, before being cast in resin, details an area surrounding a cooling duct formed according to the present invention, as shown in FIG. 2. The coil 10 is wound on a lathe that turns slowly. An absorbent reinforcing material such as dry fiberglass or a woven fiberglass mat becomes the first layer 30. Wire conductors 26, either copper or aluminum, are wound on the lathe, with an absorbent material 32 being placed between adjacent turns and after the layer is complete. Wire conductors 26 will continue to be wound over the new layer and the process repeated until a predetermined number of conductor turns and layers is reached. Wire conductor 26 beginnings and endings are brought out to terminal board 20 and terminals 22, not shown, to provide the different tap input voltages.

Absorbent mats 34 and 36 form the inside walls of an airduct created by a thermoplastic tooling segment 40. Space 38 for connecting bridges between consecutive air ducts 18 in the same layer, is also filled with an absorbent material. The same absorbent material 32 could be used in these connecting bridges. However, this material is thin and requires many pieces to adequately fill the spaces 38. A low cost fiber glass mat can be used between the air ducts for connecting bridges. It can be cut to size and installed more quickly than the thin glass mat 32. One piece of fiber glass mat is cut and installed rather than many pieces. The remaining layers and conductors are wound in a similar manner until the coil is complete, with absorbent mat 42 forming the final layer. If additional layers of cooling ducts are required, they are also formed using the same method. Before casting, the ends of the thermoplastic tooling segment 40 are sealed to prevent resin from entering during the casting process unless solid segments are used.

After the coil is cast, impregnated, or saturated with resin, the tooling segments 40 are withdrawn, resulting in a continuous cooling duct. The absorbent mat layers 30, 34, 36, and 42 impregnated with the cast resin form the exterior surface of the finished coil 10 and the cooling ducts 16. These ducts 16 are in immediate proximity to the conductor winding and can therefore provide effective convection cooling. The thickness of the cooling duct 16 will have a thickness measured radially ranging from ¼ inch to 1 inch. It will also have an arc length of several inches. If a hollow extruded segment is used its radius of curvature will match the coil radius since it is ideally formed by a flexible tooling segment that conforms to the shape of the adjacent winding layer. Unlike machined metallic segments or straight segments that have no curvature, this will eliminate any unnecessary bulges in the shape of the coil, which can increase the overall size of the finished cast coil.

These thermoplastic tooling segments 40 can be fabricated from sheet stock or thick wall tubing or in the case of hollow segments more conveniently by extrusion. In the case of relatively small coils they might be injection molded or cast. Extrusion is a preferred technique because it can produce relatively long tooling segments 40 with a uniform cross section. The extrusion process is capable of producing tooling segments 40 of convenient cross section for effective cooling of transformers from at least a hundred kVA to at least several MVA. The cooling ducts can be several feet long.

The preferred thermoplastic design is a solid piece of material having an uniform cross section, either machined, thermoformed or extruded. A relatively small number of designs with arc lengths of about 2 to 6 inches and radii of curvature of about 6 to 15 inches are adequate to manufacture coils for transformers from about 500 to about 10,000 kVA.

The thermoplastic material used should not react with nor bond to the coil bonding resin. It should have a heat distortion temperature high enough to resist heat associated with the resin curing process. To facilitate removal the thermoplastic material should have a coefficient of thermal expansion greater than the coil bonding resin system. The preferred thermoplastic material for the segments used with bisphenol A epoxy resins cured with cyclic anhydrides at about 150 degree C is polypropylene. Ovens used in cure cycles normally reach about 150 degrees C. Polyethylene gives less satisfactory results. Polystyrene is not suitable. Although Polypropylene is normally considered to be a relatively low temperature thermoplastic with a maximum service temperature of about 125 degrees C., it has been found that polypropylene works quite well.

Figure 3:
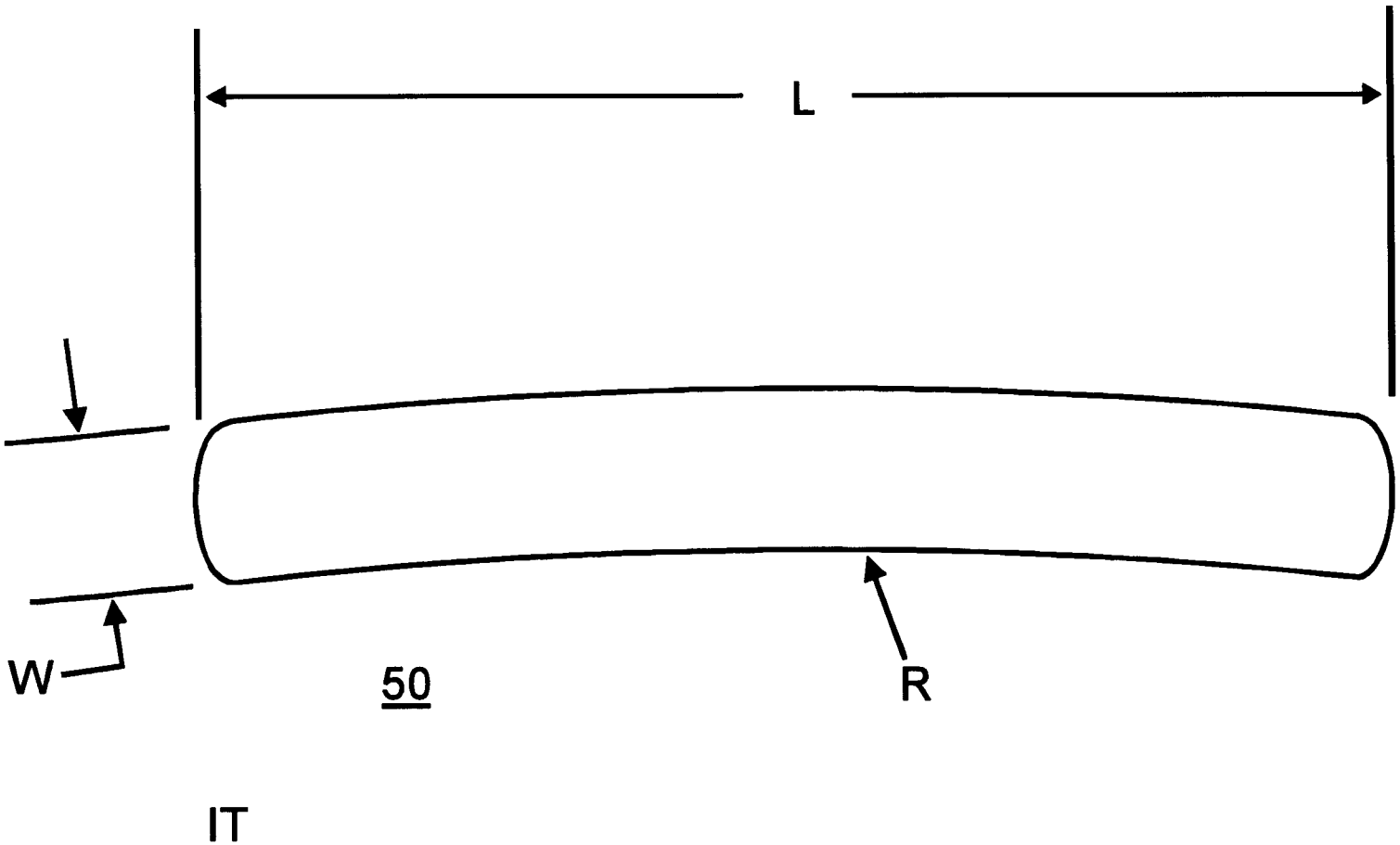
FIG. 3 is a detailed cross sectional view of one type of a thermoplastic tooling segment used to form a cooling duct in a cast resin transformer coil.

A detailed cross sectional view of one type of a solid thermoplastic tooling segment 50 used to form a cooling duct in a cast resin coil is shown in FIG. 3. This segment has a nominal cross-sectional length L of 5 inches and a nominal width W of 0.75 inches. The tooling segment 50 is crescent shaped, having a mean radius of 13 inches. The overall length of the segment is dependent on the height of the coil where it will be used. The thermoplastic material is preferably polypropylene, which results in a tooling segment 50 that will conform to the shape of elliptical or similarly shaped coils without adding unwanted bulges in the windings.

Figure 4:
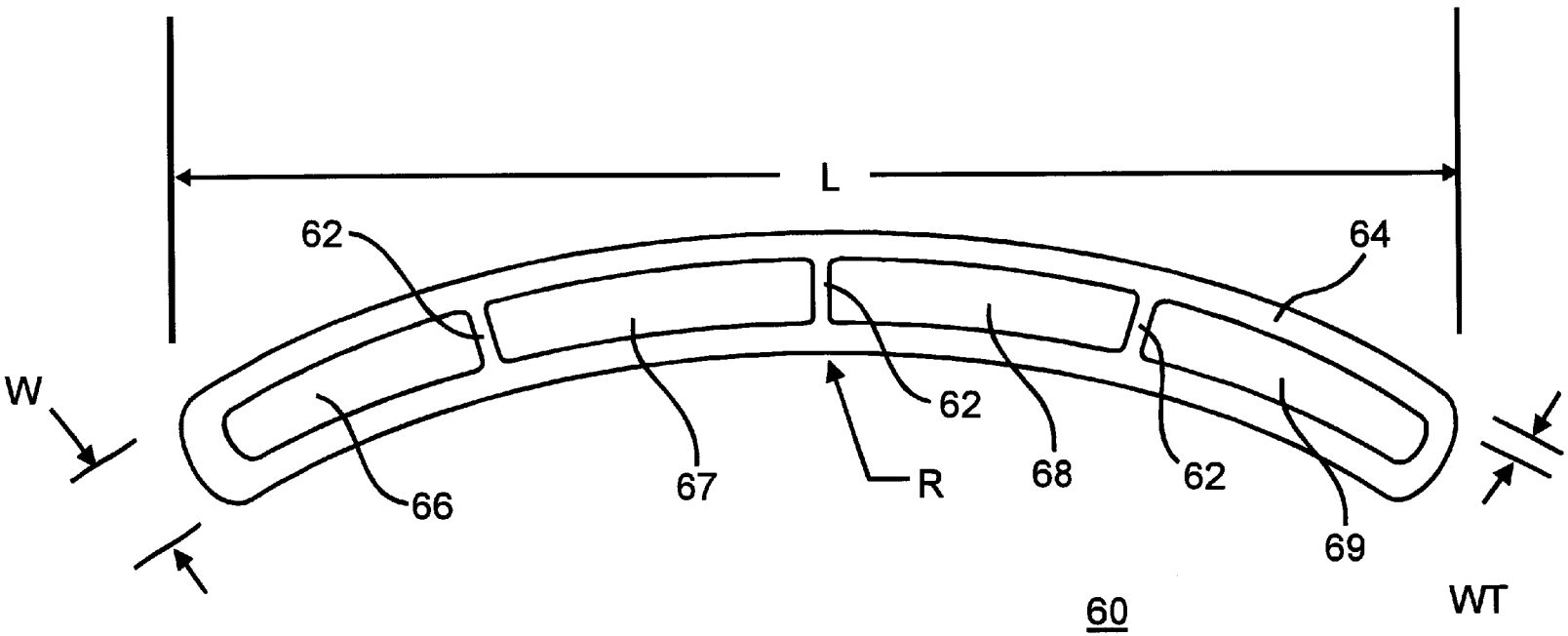
FIG. 4 is a detailed cross sectional view of a larger type of a thermoplastic tooling segment used to form a cooling duct in a cast resin transformer coil.
Figure 6:
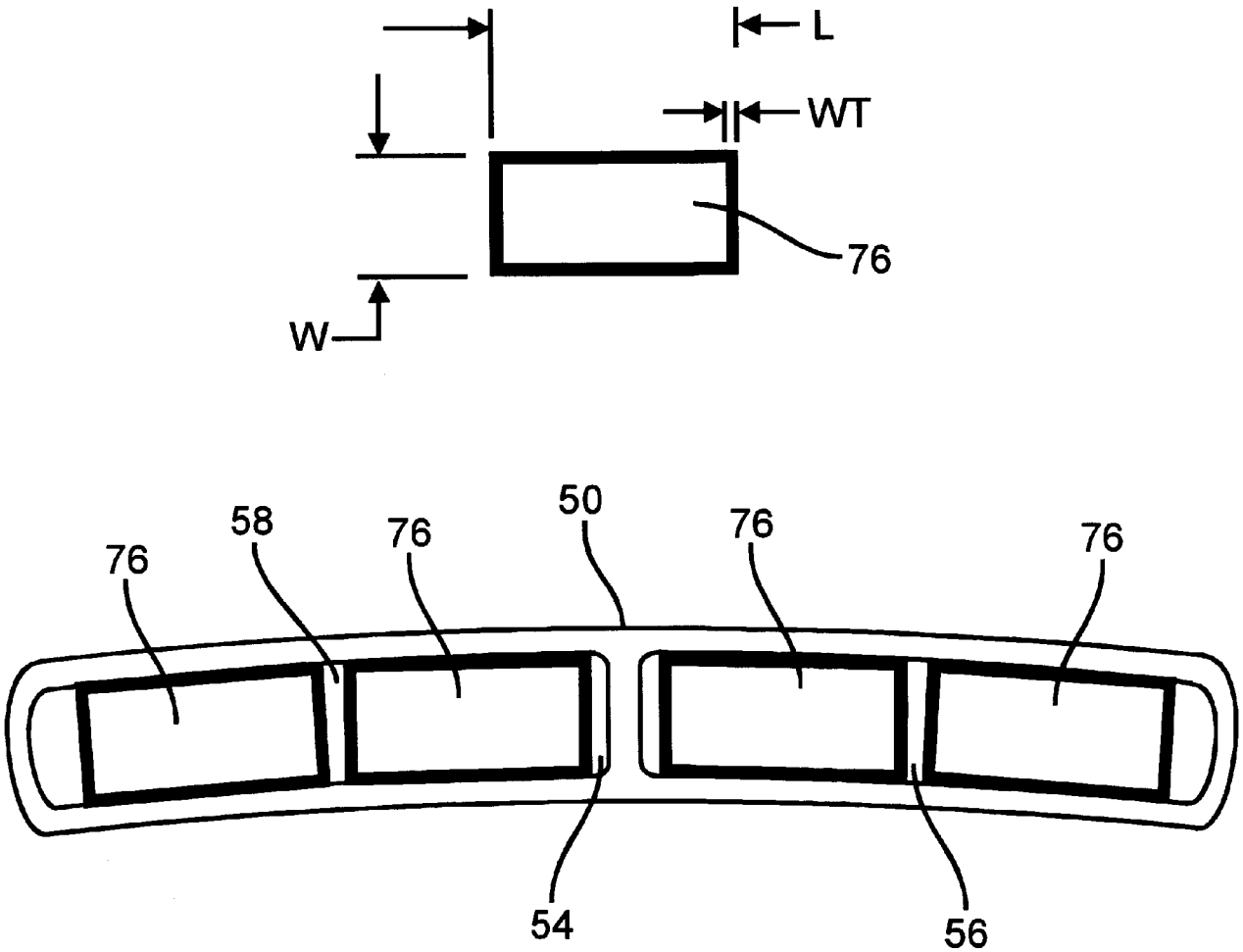
FIG. 6 is a detailed cross sectional view of the thermoplastic tooling segment of FIG. 3 detailing a method of reinforcing the segment to allow thinner outside walls.

In practice it is also possible to manufacture thermoplastic tooling segments 40 by extrusion with uniform wall thickness of about 1/10 inch. The wall thickness should be adequate to resist extraction and winding forces. Thus a tooling segment used to create a duct with a nominal thickness of ¾ inch in a cylindrical coil would be in the form of a tube with a generally crescent shaped cross section ¾ inch thick. To adequately resist winding forces a reinforcing rib or ribs perpendicular to the main segment walls may be used as shown in FIGS. 4 and 6. Relatively thin walled extrusions are used that are somewhat flexible so that the winding tension from the conductor and/or fiber glass or other reinforcing material will cause the radius of curvature of the segment to conform to the shape of the winding. This will have the effect of reducing the number of different segment designs required to support production of a variety of different diameter coils. Longitudinal reinforcing bars or tubes can be used to prevent the thin walled plastic extrusion from collapsing from tension in the winding, which will be discussed later. Another advantage of flexible segments is that elliptical or similarly shaped coils with conforming cooling ducts are possible using only one segment design.

A larger type of a thermoplastic tooling segment 60 used to form a cooling duct in a cast resin coil is detailed in the cross sectional view of FIG. 4. This segment has a nominal cross-sectional length L of 9 inches and a monimal width W of 0.75 inches. Reinforcing ribs 62 are centered and perpendicular to the main segment walls 64 and have an approximate thickness RT of 3/16 inches. This will create four inner openings 66, 67, 68, and 69. The main segment walls 64 have a nominal 3/16 inches thickness WT. The tooling segment 60 is also crescent shaped, having a mean radius of 7 ¾ inches. As with tooling segment 50 the overall length of the segment is dependent on the height of the coil where it will be used. The extruded thermoplastic material is also preferably polypropylene, which results in a flexible tooling segment 60. This segment is more flexible than the extruded or machined thermoplastic tooling segment 50 shown in FIG. 3.

Figure 5:
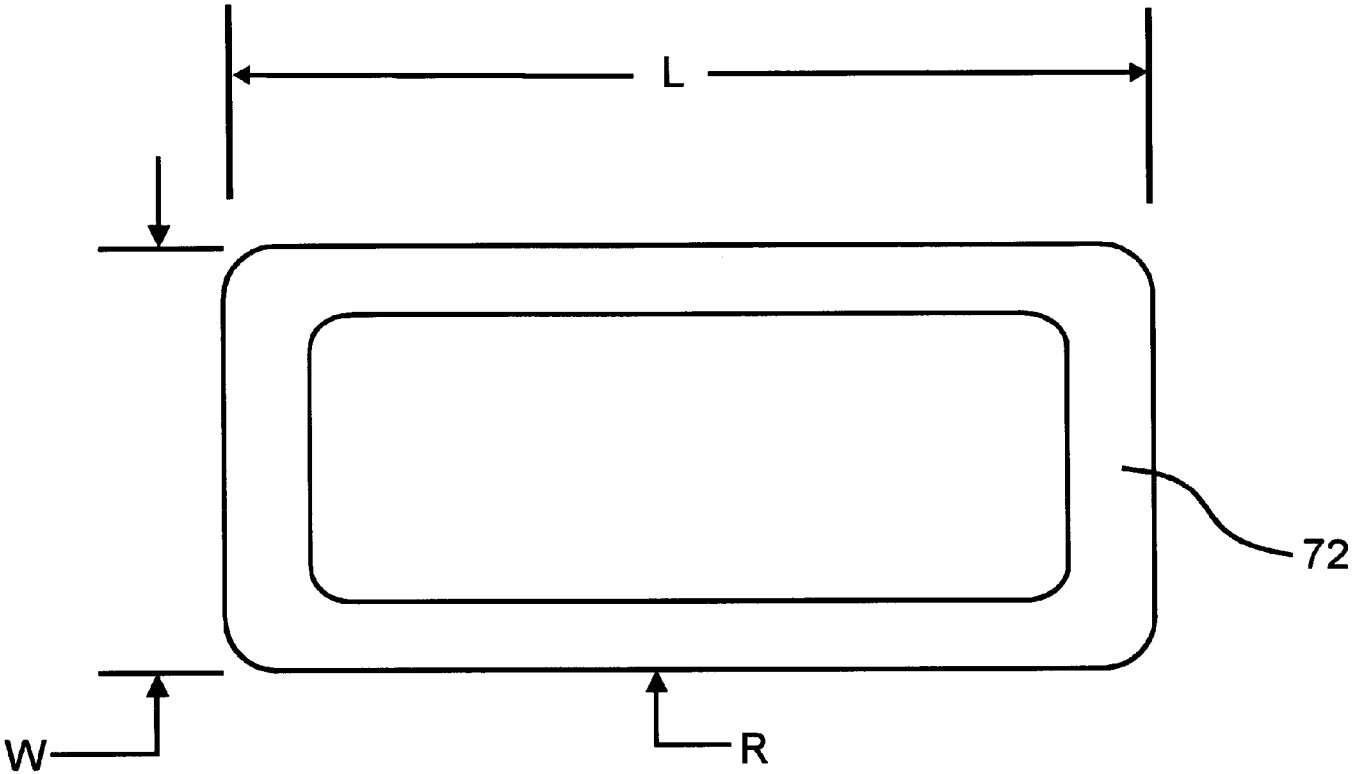
FIG. 5 is a detailed cross sectional view of a smaller type of a thermoplastic tooling segment used to form a cooling duct in a cast resin transformer coil.

FIG. 5 illustrates a smaller type of a thermoplastic tooling segment 70. This segment has a nominal cross-sectional length L of 2 inches and a nominal width W of 0.75 inches. The main segment walls 72 have a nominal 3/16 inches thickness WT. The tooling segment 70 is also crescent shaped, having a mean radius of 15 inches. As with tooling segments 50, 60, the overall length of the segment is dependent on the height of the coil where it will be used. The extruded thermoplastic material is also preferably polypropylene, which results in a flexible tooling segment 70. Due to the thicker walls this segment is also less flexible than the extruded thermoplastic tooling segment 60. This segment might be used to complete a circle of larger cooling ducts or in a coil with a large radius in which the bulging effect is minimal due to the small subtended angle of the 2 inch segment. The dimensions L, W, R, RT, and WT are given only as one set of values and are not meant to be restrictive. Other values are possible without limiting the scope of the present invention. This segment could also be made by machining a solid thermoplastic material, as discussed above.

A method of reinforcing the tooling segments is detailed in FIG. 6. Metallic bars or tubes are used as supporting elements inside a relatively thin sheath of suitable thermoplastic material, thus giving the tooling segment greater flexibility. Using the thermoplastic tooling segment 50 of FIG. 3, two rectangular aluminum tubes 76 are inserted in each of the two inner openings 56, 58. The aluminum tubes 76 have a nominal length L of 1 inch and a nominal width W of ½ inch. The wall thickness WT is 1/16 inch. Other values are possible without limiting the scope of the present invention.

Before casting the wound coil 10, it is necessary to seal the ends of the thermoplastic tooling segment 40. One method is to just seal the lower end of the tooling segments. After casting, a gripper tool is inserted through the top opening and is used to pull the tooling segments from the cast coil. Since the preferred thermoplastic material for the segments is polypropylene, which is chosen for its ability not to react with nor bond to the coil bonding resin, some processing of the tooling segment is necessary to allow a sealant to adhere to it. It has been found that using a corona treatment of the inner surfaces of the ends of the thermoplastic tooling segments using a Tesla coil solved the problem. This allows an epoxy or a silicone rubber plug followed with silicone RTV to be used. The upper end could be plugged with an amine cure epoxy and then drilling extraction holes through the polypropylene and the epoxy.

Figure 7:
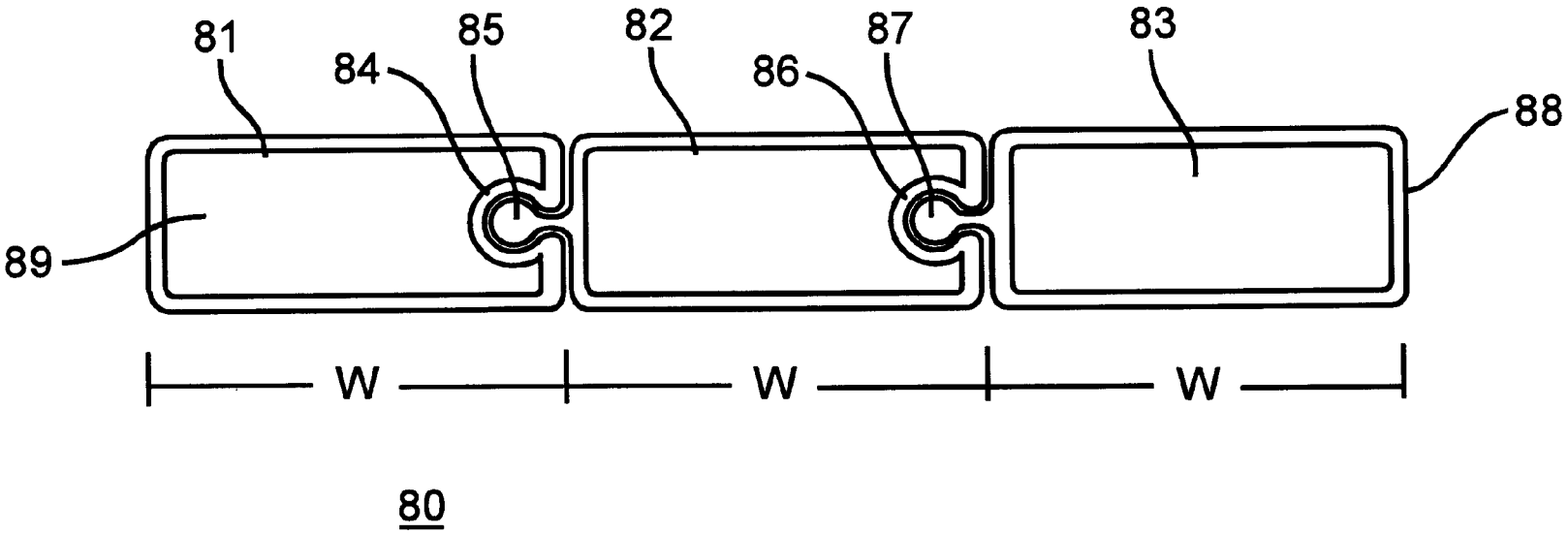
FIG. 7 is a detailed cross sectional view of snap-together segments to allow for varying cooling duct sizes by using one type of a thermoplastic tooling segment.

Other variations for the tooling segments are possible. FIG. 7 illustrates how several extrusions 81, 82, 83 coupled together using snap together elements are joined edge-to-edge to create a tooling segment 80 of varying length. In the preferred embodiment, the segments are solid thermoplastic tooling segments. Left end segment 81 forms one side 89 of the tooling segment 80 and has an opposite side 84 tooled to receive an extension 85 from one side of middle segment 82. Middle segment 82 also has its opposite side 86 tooled the same as tooled side 84 of segment 81. This will allow side 86 to receive an extension 87 from one side of right end segment 83, with side 88 completing the tooling segment 80. The snap together ends 84–85 and 86–87 have sufficient freedom to allow some rotation, allowing the tooling segment 80 to have a flexible curvature to match the shape of the coil where it is applied. The Length L of each segment 81,82, 83 is identical to create a tooling segment 80 having a total length of 3 L.

Since the matched end segments 84–85 and 86–87 are identical, tooling segment 80 could consist of just segments 81 and 83 to create a tooling segment 80 having a length of 2 L. Likewise, an additional middle segment 82 could be inserted between the middle segment 82 and either end segment 81 or 83 to create a tooling segment 80 having a length of 4 L. Additional middle segments 82 could be employed to create a tooling segment 80 having a length of a multiple of length L.

Figure 8:
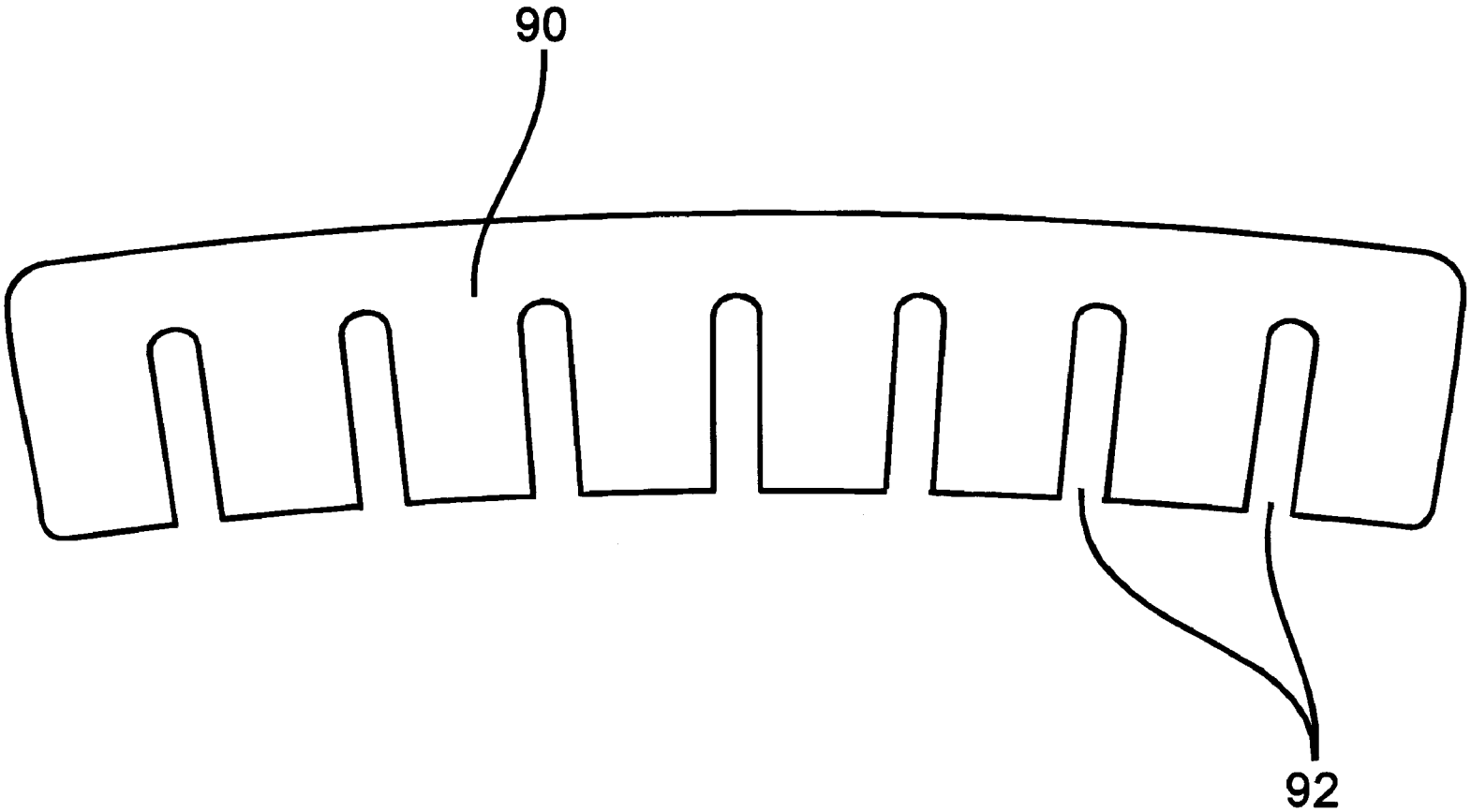
FIG. 8 is a detailed cross sectional view of one variation of the thermoplastic tooling segment used to form a cooling duct in a cast resin transformer coil shown in FIG. 1.

Another variation of a tooling segment 90 is illustrated in FIG. 8. A series of deep grooves 92, running the length of the extrusion, are located on one longitudinal side of the segment 90. During winding, the grooved ends compress towards each other to create a flexible arc segment that will conform to the shape of the coil. Before casting, the top and bottom sides of the tooling segment 90 are covered with a suitable tape to exclude liquid resin during the casting process.

Figure 9:
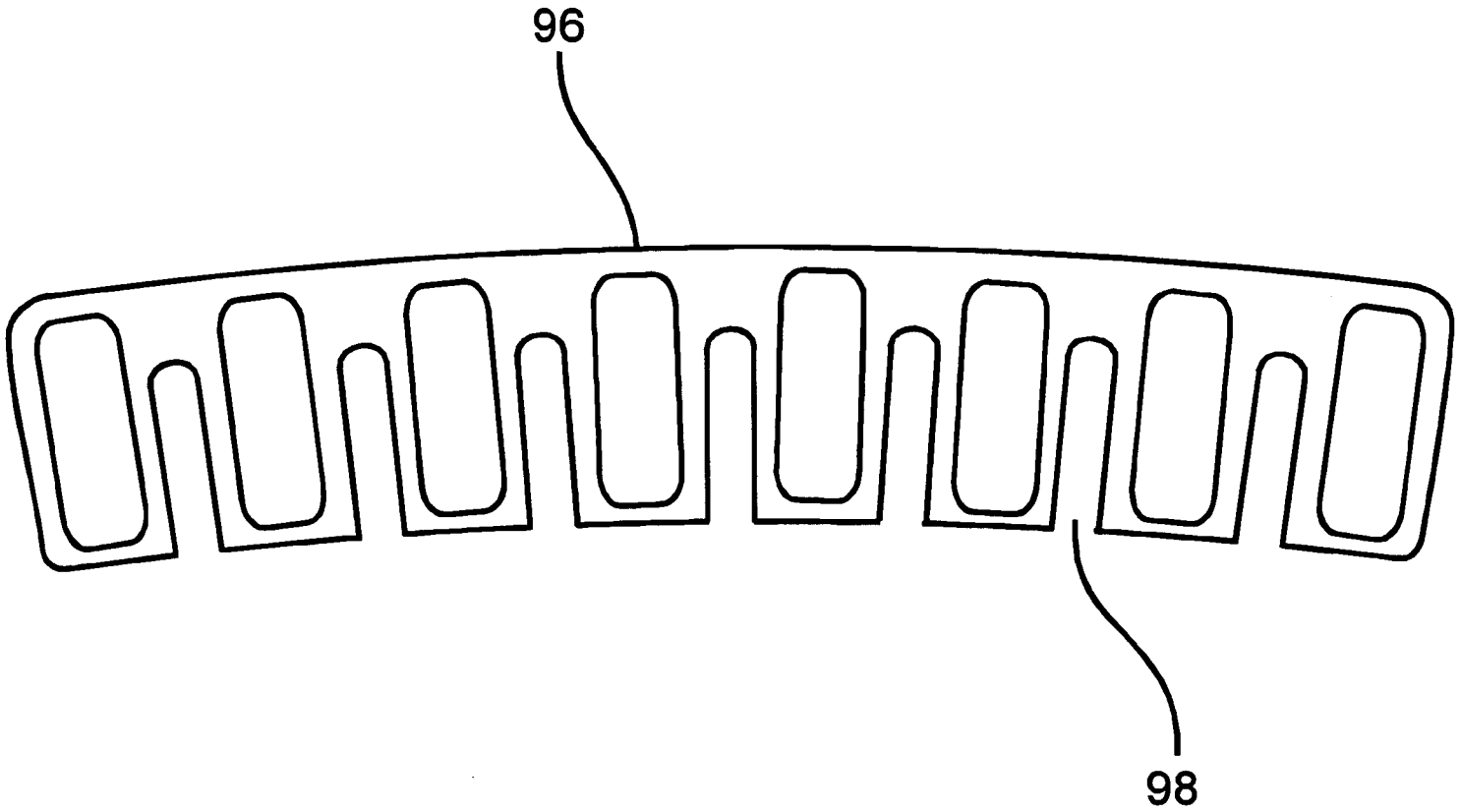
FIG. 9 is a detailed cross sectional view of a further variation of the thermoplastic tooling segment used to form a cooling duct in a cast resin transformer coil as shown in FIG. 1.

FIG. 9 illustrates a further variation of tooling segment 90. Area 94 is removed between grooves 98 to eliminate material and to make the tooling segment 96 more flexible and that will conform more readily to the shape of the coil. As with tooling segment 90, before casting, the top and bottom are covered with a suitable tape to exclude liquid resin during the casting process.

The use of the above described tooling elements provides greater flexibility in coil design. Adding cooling channels to coils using these elements is not limited by the cost factors involved to remove the prior art tooling segments. This means that more channels can be easily added, resulting in coil windings that operate more efficiently due to increased air flow for heat removal.

While the specific embodiments have been illustrated and described, numerous modifications are possible without departing from the scope or spirit of the invention. Whereas the present invention describes a wire wound coil, a strip wound, commonly used as a secondary coil could also employ the above described method to create cooling ducts within the cast coil.

We claim:

1. A method of forming cooling channels in a coil wound about an axis, comprising:

A. winding on a mandrill, an insulating material coincident with a conductor material, starting at a first point, a first predetermined number of turns;

B. adding an absorbent reinforcing material after the first predetermined number of turns of the winding to form a first layer in the wound coil;

C. placing a plurality of thermoplastic tooling elements in the first layer, oriented parallel to the axis of the wound coil and at predetermined intervals, the tooling elements either solid or tubular with reinforcing elements, the tooling elements extending through the coil's height, the tooling elements are fabricated from a thermoplastic material having a coefficient of thermal expansion greater than resin used in encapsulating the wound coil;

D. adding additional absorbent reinforcing material over the first plurality of tooling elements to form a second layer and to form a pocket between adjacent tooling elements, the formed pockets for providing a bridge between adjacent windings;

E. adding absorbent mats to fill the formed pockets between adjacent tooling elements;

F. continue winding the sheet insulator material coincident with the conductor material, and repeating the method until a predetermined number of turns and layers are reached;

G. adding a final layer of absorbent reinforcing material after the predetermined number of turns and layers is reached;

H. encapsulating the coil winding with resin; and

I. removing the plurality of thermoplastic tooling elements, forming a continuous cooling channel in the wound coil, the cooling channel conforming to the shape of the wound coil.

2. The method of claim 1 wherein the thermoplastic tooling element has a crescent shaped cross section throughout its length, the crescent shape having a radius to conform with the tooling element's position from the axis of the wound coil.

3. The method of claim 2 wherein the thermoplastic tooling element is machined from a sheet stock of thermoplastic material to form a solid tooling element.

4. The method of claim 2 wherein the thermoplastic tooling element is extruded from a thermoplastic material to form a solid tooling element.

5. The method of claim 2 wherein the thermoplastic tooling element is injection molded with thermoplastic material in a form to form a solid tooling element.

6. The method of claim 1 wherein the thermoplastic material is polypropylene.

7. The method of claim 2 wherein the thermoplastic tooling element is extruded from a thermoplastic material to form a hollow, relatively thick walled rigid shaped tooling element, having a series of chambers, which are sealed before encapsulating the wound coil.

8. The method of claim 2 wherein the thermoplastic tooling element is extruded from a thermoplastic material to form a hollow, relatively thin-walled flexible shaped tooling element, having a series of chambers, with reinforcing elements, which are sealed before encapsulating the wound coil, the thin-walled tooling elements providing a tooling element that can conform to the shape of elliptical or similar shaped wound coils.

* * * * *